US008647751B2

(12) United States Patent
Endicott et al.

(10) Patent No.: US 8,647,751 B2
(45) Date of Patent: Feb. 11, 2014

(54) COATED VALVE RETAINER

(75) Inventors: Mark Thomas Endicott, Morresville, NC (US); Randall John Wischhusen, Chesterland, OH (US)

(73) Assignee: Wide Open Coatings, Inc., Mooresville, NC (US)

( * ) Notice: Subject to any disclaimer, the term of this patent is extended or adjusted under 35 U.S.C. 154(b) by 511 days.

(21) Appl. No.: 12/822,644

(22) Filed: Jun. 24, 2010

(65) Prior Publication Data

US 2010/0258073 A1 Oct. 14, 2010

Related U.S. Application Data

(60) Division of application No. 11/284,176, filed on Nov. 21, 2005, now Pat. No. 7,767,267, which is a continuation-in-part of application No. 10/454,449, filed on Jun. 4, 2003, now abandoned.

(51) Int. Cl.
*B32B 5/00* (2006.01)

(52) U.S. Cl.
USPC ..... 428/550; 427/449; 427/450; 427/455; 427/456; 123/188.9; 123/188.11; 123/188.12; 123/188.13

(58) Field of Classification Search
None
See application file for complete search history.

(56) References Cited

U.S. PATENT DOCUMENTS

| | | | | | |
|---|---|---|---|---|---|
| 3,617,349 | A | * | 11/1971 | Prasse | 427/233 |
| 3,875,042 | A | * | 4/1975 | Grunig | 204/290.03 |
| 4,123,122 | A | * | 10/1978 | Gabrielson et al. | 384/300 |
| 4,902,359 | A | * | 2/1990 | Takeuchi et al. | 148/222 |
| 5,040,501 | A | | 8/1991 | Lemelson | |
| 5,040,504 | A | * | 8/1991 | Matsuoka | 123/254 |
| 5,080,056 | A | | 1/1992 | Kramer et al. | |
| 5,116,430 | A | * | 5/1992 | Hirai et al. | 148/518 |
| 5,385,683 | A | | 1/1995 | Ransom | |
| 5,578,176 | A | * | 11/1996 | Hardee et al. | 204/290.08 |
| 5,713,129 | A | | 2/1998 | Rastegar et al. | |
| 5,819,774 | A | | 10/1998 | Beardsley et al. | |
| 6,189,663 | B1 | | 2/2001 | Smith et al. | |
| 6,203,895 | B1 | | 3/2001 | Berger et al. | |
| 6,263,250 | B1 | * | 7/2001 | Skinner | 607/126 |
| 2005/0016489 | A1 | * | 1/2005 | Endicott et al. | 123/193.2 |
| 2005/0092961 | A1 | | 5/2005 | Ucman | |

FOREIGN PATENT DOCUMENTS

| | | | |
|---|---|---|---|
| JP | 62-256956 | * | 11/1987 |
| JP | 2002-115514 | * | 4/2002 |

OTHER PUBLICATIONS

Thermal Spraying Practice, Theory, and Application, American Welding Society, inc, Mar. 1986.*
Thermal Spraying: Practice, Theory, and Application, American Welding Society, Inc., 1985, pp. 42, 43, 64, 108-109.

* cited by examiner

*Primary Examiner* — Mark Ruthkosky
*Assistant Examiner* — Daniel J. Schleis
(74) *Attorney, Agent, or Firm* — Thompson Hine L.L.P.

(57) ABSTRACT

During engine operation, valve retainers and valve springs are constantly rubbing and impacting each other resulting in heat and wear. The purpose of this invention is to provide a surface coating onto the valve retainer to reduce the friction with the valve spring and thus improve durability. Specifically, this invention teaches a method to thermally apply coatings to the surface of the valve retainer. Although typically fabricated from steel, the usage of lighter weight titanium valve retainers is increasing for high performance, or racing engines. The reduced mass allows valves to move more readily and requires less spring pressure to operate, producing more power and a faster revving engine, however titanium is typically not as wear resistant as the steel it replaces. In one embodiment, a porous molybdenum or other oleophilic metal is applied to the surface of the valve retainer. In another embodiment, hard coatings of cermets, carbides, and super alloys are applied as coatings to valve retainers.

17 Claims, No Drawings

COATED VALVE RETAINER

CROSS-REFERENCE TO RELATED APPLICATIONS

This application is a divisional of prior U.S. application Ser. No. 11/284,176, filed Nov. 21, 2005, now pending, which is a continuation-in-part of prior U.S. application Ser. No. 10/454,449, filed Jun. 4, 2003, now abandoned.

STATEMENT REGARDING FEDERALLY SPONSORED RESEARCH OR DEVELOPMENT

Not Applicable

BACKGROUND OF INVENTION

The valves of an internal combustion engine control the flow of gases into and out of the combustion chamber and are typically composed of a disk with a seating surface and an integral stem. Valves are opened by cams and closed with springs. Valve retainers are held against a groove on the valve stem and keep the valve spring in compression. The valve retainer is circular with a center hole surrounded by a protrusion. Although typically fabricated from steel, the usage of lighter weight titanium valve retainers is increasing for high performance, or racing engines. The reduced mass allows valves to move more readily and requires less spring pressure to operate, producing more power and a faster revving engine, however titanium is typically not as wear resistant as the steel it replaces.

During engine operation, valve retainers and valve springs are constantly rubbing and impacting each other resulting in heat and wear. The purpose of this invention is to provide a surface coating onto the valve retainer to reduce the friction with the valve spring and thus improve durability. Specifically, this invention teaches a method to apply coatings to the surface of the valve retainer by a thermal spray technique. In one embodiment, a porous molybdenum or other oleophilic metal is applied to the surface of the valve retainer. In another embodiment, hard coatings of cermets, carbides, and super alloys have also been applied as coatings to valve retainers.

Valve springs, while typically made of steel, can be coated to reduce friction and to provide heat resistance to combat metal fatigue. Coatings are typically based on a PTFE polymeric coating or on a high temperature dry film lubricant. While these coatings may be used on valve retainers as well as on the springs, the retainers are typically not coated. In attempts to improve wear resistance, titanium retainers are occasionally plated with a hard coating or an oxide or nitride layer is grown on the surface. Each of these approaches has drawbacks that are solved by the current invention.

Dry film lubricants, such as those based on molybdenum disulfide or on the polymer PTFE are effective in reducing friction, but do not have good durability. Valve retainers are constantly rubbing against and impacted by the valve spring and so these types of lubricants tend to wear off; sometimes quite quickly. Hard coatings, such as chromium alloys, may be chemically or electro-plated onto the valve retainer. However, if wear and chipping of the hard coating occurs by impact with the spring or by the flexing of the valve retainer, pieces of the coating can be damaging to the engine. This was the case in a now discontinued application of a hard chromium coating, which chipped resulting in chromium particles embedding in pistons and bearings (ref. "Chevy Revs for 2002 IRL Season", by Kami Buchholz, motorsportsinternational.org, SAE International 2003).

Nitriding and anodizing of titanium or aluminum valve retainers have also been employed to improve wear resistance. However, the nature of these coatings, in which a titanium nitride or oxide layer is formed on the surface of the metal, is inherently very thin and in an application such as a valve retainer, this surface can wear very quickly.

There are examples of coatings used on valve train components in patents that detail the current state of the art technologies in use for this application. U.S. Pat. No. 5,904,125 teaches the use of a valve stem that is coated with a solid lubricant. This lubricant is specifically used in regions that are protected from hot gases so that it can survive. Although very different from the thermal spray coatings of the current invention, this patent is instructive as an example of existing technology. In U.S. Pat. No. 5,040,501, the use of an in-situ formed synthetic diamond coating, overplated with hard chromium is used to protect valves from wear and corrosion resistance. Another type of anti-friction protective coating is disclosed in U.S. Pat. No. 5,385,683, in which bismuth and tin are deposited by means of a liquid mixture of organometallic compounds. Again, these patents are given as examples of the types of valve train coating schemes that have previously been developed, although they are quite different from the thermally applied coatings of the current invention.

A common industrial method of applying hard surfaces to substrates is by the application of a weld metal deposit, or hardface. While not found to have been used for valve retainers, it is instructive to show the differences between this common method and thermal spraying. The weld overlay method involves the melting of a metal electrode or weld metal directly onto the substrate resulting in very significant heating of the substrate. Thermal spraying, on the other hand, does not significantly heat the coated substrate. A substrate coated via thermal spray can be handled within seconds after the application whereas a substrate coated by weld metal deposit hardfacing could not be handled safely for several minutes or longer. The advantage of thermal spray could therefore also be manifest in a greatly reduced chance of altering the condition, temper or properties of the substrate.

Thermal spray coatings have another advantage over lubricated, plated or hardfaced coatings in that the thermally sprayed coating can be applied such that it is not fully dense. That is, by the careful manipulation of the spray parameters, including distance, angle, and gas pressure, the apparent density ratio of the coating can be controlled. This ratio is commonly defined as the ratio of the density (weight per unit volume) of the coating to the density of a completely solid material of the same composition. In this way, fine and evenly distributed porosity can be introduced into the coating at the desired ratio. For the current invention, the porous nature of the coating is in part responsible for its effectiveness.

It is clear that while there are many technologies used commercially to coat valve train components, valve retainers are not typically coated. For high performance vehicles that use titanium valve retainers, a coating can improve the durability and life of the retainer. The polymer, solid lubricant and plated hard coatings all have considerable drawbacks that the current invention does not. A thermally sprayed porous metallic coating has the benefit of both improved wear resistance and the ability to carry oil such that it is more effectively lubricated at the point of contact. A thermal sprayed hard coating has the benefit of both high bond strength and wear resistance. This invention therefore provides for improved performance and durability over prior art technologies.

Some applications of thermal spray coatings to engine parts may be instructive in summarizing the prior art uses of this coating technology. Although specifically used only on suspension damper rods, U.S. Pat. No. 6,189,663 is instructive in that it teaches the application of a thermal or kinetic spray coating of metal or ceramic. It is noteworthy that the invention teaches that the spray coatings are improvements over plated chromium coatings. Similarly, U.S. Pat. No. 5,713,129 teaches the high velocity oxy-fuel (HVOF) method of thermal spray to provide for coated piston rings to improve wear resistance. U.S. Pat. No. 5,080,056 teaches the thermal spraying of aluminum cylinder bores and piston skirts with an aluminum-bronze alloy to improve wear and scuff resistance. These are just examples of the prevailing state of the art for thermally sprayed coating engine components; typically not those included in the valve train. The application of porous or hard surfaces to lightweight valve retainers is a novel application of thermal coating technology, to apply specific materials to achieve superior performance.

In addition to the references cited above, there is prior art in a commercial technology in which molybdenum metal is used to face the top piston ring to enhance compression sealing to improve engine performance. This method involves a mechanical or thermally sprayed on layer of molybdenum (or chromium) on the outer, or wear surface of the ring. It is recognized that a molybdenum layer on the ring can enhance the life of the piston due to the slightly porous nature of the coating, which is advantageous for the ability to carry oil. While the use of thermally sprayed molybdenum is one of the important embodiments of this invention, its use has been limited to the piston rings and there appears to be no prior art of its use on valve train components.

Thus, it is clear that the prior art for lightweight valve retainer coatings involve dry lubricants, polymers, plated chromium, nitrided or oxidized surfaces. While thermal spray processes have been utilized for other engine components, they have not been employed to coat valve train components. Finally, the benefits of a porous metallic surfaces as well as hard coatings have been recognized, but only as applied to other engine components. It is clear therefore, that the application of a metallic, porous and thus oil-bearing, surface to valve retainers via a thermal spray process is a novel and valuable invention. It is also clear that the application of thermally applied hard coatings to valve retainers is also a novel and valuable invention.

BRIEF SUMMARY OF THE INVENTION

The present invention provides for a process in which titanium, aluminum, alloys of these metals, or other lightweight valve retainers are thermally coated to provide for improved wear resistance and durability. In one embodiment, valve retainers are coated with a porous, oleophilic metallic layer. This layer contains controlled porosity such that it has no greater than a 95% apparent density ratio. Furthermore, the thermal spraying is performed such that the retainer is not heated more than 100° C., thus preserving its metallurgical state. In a preferred embodiment, the valve retainer is thermally sprayed with molybdenum metal or a molybdenum alloy. In another preferred embodiment, the valve retainer is coated with a layer of brass or bronze. These metallic layers provide wear resistance to the titanium alloy valve retainer due to the hard and increased oil-carrying capacity of the thermally applied, porous surface. In another embodiment, hard metallic or cermet coatings are applied via thermal spray to the valve retainer. In another embodiment, the porous coating is impregnated with a polymer.

BRIEF DESCRIPTION OF THE SEVERAL VIEWS OF THE DRAWING

Not Applicable

DETAILED DESCRIPTION OF THE INVENTION

According to the present invention, lightweight valve spring retainers are grit blasted in preparation for thermal spray surface treatment. A coating is then applied via a thermal spray technique, such as plasma spray, HVOF, twin-wire arc, detonation gun or cold spray. The coating can be a refractory metal, although an alloy, a cermet, carbide (such as of titanium, chromium, tungsten, or boron), ceramic or other like material can be used. In one embodiment, the application of the coating is such that it is bonded well with the retainer substrate and the surface finish is rough and somewhat porous. It is the combination of the coating material's rough surface texture and the porous nature of the coating that provides for the improved wear resistance over prior art coatings by providing for both wear resistance and the ability for the surface to carry and retain oil. In another embodiment, the porous coating is impregnated with a lubrication agent or polymer.

Example 1

Step 1: The valve spring seating areas of titanium alloy valve retainers were abrasively blasted to create a surface roughness of 200+/−25 microinches. Surfaces other than the spring seating area were masked off with thermal tape.

Step 2: A thermal plasma torch was used run on an $N_2H_2$ gas mixture at 28.4 kW using a 5.5-inch spray distance and a powder flow rate of 5 pounds per hour. In this example, molybdenum alloy, −170/+325 mesh size was the coating material.

Step 3: Excess powder was brushed off the retainers, the masking removed and the retainers were fitted into the valve train.

In the above example, 16 of the valve retainers were fitted into a V-8 race car engine and run for 2100 race miles. Upon inspection of the retainers it was found that there was no discernable wear of the titanium substrate and only limited wear of the molybdenum coating. In addition, uncoated titanium valve retainers were also fitted into a V8 race car engine and run for 500 race miles. Upon inspection, 30 grams of titanium were found in the engine's filters, or just under 12% of the total 256 g weight of the 16 retainers. This extreme wear is dangerous in that once the retainers wear down to a critical thickness, the applied loads during engine operation can result in fracture, setting off a chain of events that ultimately lead to complete engine failure.

Example 2

Step 1: The valve spring seating areas of titanium alloy valve retainers were abrasively blasted to create a surface roughness of 200+/−25 microinches. Surfaces other than the spring seating area were masked off with thermal tape.

Step 2: A thermal spray wire process was used in which wire was passed through an oxy-acetylene flame and propelled at the valve retainers by compressed air. A 4-inch spray distance and a spray rate of 4 pounds per hour were used with a molybdenum metal wire, 0.125-inch diameter.

Step 3: The masking was removed from the valve retainers and they were fitted into the valve train.

It is recognized that while the present invention has been described with reference to preferred embodiments, various details of the invention can be changed without departing from the scope of the invention. Furthermore, no limitations are intended to the details of the process shown, other than as described in the claims below.

The invention claimed is:

1. An automotive valve spring retainer comprising:

an automotive valve spring retainer made of titanium, aluminum, an alloy of titanium, or an alloy of aluminum, wherein said valve spring retainer has a titanium, aluminum, alloy of titanium, or alloy of aluminum impact wearing surface; and a coating consisting essential of the metal molybdenum or a molybdenum alloy, wherein said coating is porous and directly contacts said impact wearing surface;

wherein said coating has been applied by thermal spraying using a thermal spray technique selected from the group consisting of high velocity oxy-fuel (HVOF), plasma, twin-wire arc, detonation gun, and cold spray, and wherein said valve spring retainer has not been heated during the application of said coating by more than 100° C.

2. The automotive valve spring retainer of claim 1, wherein surface finish of the coating is rough and porous.

3. The automotive valve spring retainer of claim 1, wherein said coating is impregnated with a polymer.

4. The automotive valve spring retainer of claim 1, wherein said impact wearing surface is a valve spring seating area.

5. The automotive valve spring retainer of claim 1, wherein said coating has no greater than a 95% apparent density ratio.

6. An automotive valve spring retainer comprising:

an automotive valve spring retainer having a substrate of titanium, aluminum, an alloy of titanium, or an alloy of aluminum, and an impact wearing surface of titanium, aluminum, an alloy of titanium, or an alloy of aluminum; and a impact wearing surface coating consisting essentially of the metal molybdenum or a molybdenum alloy, wherein said coating has no greater than a 95% apparent density ratio and directly contacts said impact wearing surface.

7. The automotive valve spring retainer of claim 6, wherein surface finish of the coating is rough and porous.

8. The automotive valve spring retainer of claim 6, wherein said coating is impregnated with a polymer.

9. The automotive valve spring retainer of claim 6, wherein said impact wearing surface is a valve spring seating area.

10. The automotive valve spring retainer of claim 6, wherein said coating is the product of a thermal spray process, and wherein said valve spring retainer substrate has not been significantly heated by thermal spraying so as to alter the temper of the substrate.

11. The automotive spring retainer of claim 10, wherein said valve spring retainer substrate has not been heated by thermal spraying by more than 100° C.

12. An automotive valve ring retainer comprising:

an automotive valve spring retainer having a substrate of titanium, aluminum, an alloy of titanium, or an alloy of aluminum, and an impact wearing surface of titanium, aluminum, an alloy of titanium, or an alloy of aluminum; and a impact wearing surface coating consisting primarily of zero-oxidation-state molybdenum, wherein said coating has no greater than a 95% apparent density ratio and directly contacts said impact wearing surface.

13. The automotive valve spring retainer of claim 12, wherein surface finish of the coating is rough and porous.

14. The automotive valve spring retainer of claim 12, wherein said coating is impregnated with a polymer.

15. The automotive valve spring retainer of claim 12, wherein said impact wearing surface is a valve spring seating area.

16. The automotive valve spring retainer of claim 12, wherein said coating is the product of a thermal spray process, and wherein said valve spring retainer substrate has not been significantly heated by thermal spraying so as to alter the temper of the substrate.

17. The automotive spring retainer of claim 16, wherein said valve spring retainer substrate has not been heated by thermal spraying by more than 100° C.

* * * * *

UNITED STATES PATENT AND TRADEMARK OFFICE

CERTIFICATE OF CORRECTION

PATENT NO. : 8,647,751 B2
APPLICATION NO. : 12/822644
DATED : February 11, 2014
INVENTOR(S) : Mark Thomas Endicott et al.

It is certified that error appears in the above-identified patent and that said Letters Patent is hereby corrected as shown below:

In the Claims

In Claim 1, at Column 5, Line 14 reads:

"a coating consisting essential of the metal molybdenum or"

It should read:

-- a coating consisting essentially of the metal molybdenum or --

Signed and Sealed this
Third Day of June, 2014

Michelle K. Lee

Michelle K. Lee
*Deputy Director of the United States Patent and Trademark Office*